US012162116B2

(12) United States Patent
Boller et al.

(10) Patent No.: US 12,162,116 B2
(45) Date of Patent: Dec. 10, 2024

(54) DOUBLE-SIDE OR ONE-SIDE MACHINING MACHINE

(71) Applicant: Lapmaster Wolters GmbH, Rendsburg (DE)

(72) Inventors: Hans-Peter Boller, Fockbeck (DE); Ingo Neuber, Bornstein (DE)

(73) Assignee: Lapmaster Wolters GmbH, Rendsburg (DE)

( * ) Notice: Subject to any disclaimer, the term of this patent is extended or adjusted under 35 U.S.C. 154(b) by 137 days.

(21) Appl. No.: 17/486,192

(22) Filed: Sep. 27, 2021

(65) Prior Publication Data

US 2022/0097205 A1 Mar. 31, 2022

(30) Foreign Application Priority Data

Sep. 28, 2020 (DE) ..... 102020125246.3

(51) Int. Cl.
*B24B 51/00* (2006.01)
*B24B 7/10* (2006.01)

(52) U.S. Cl.
CPC ..... *B24B 51/00* (2013.01); *B24B 7/10* (2013.01)

(58) Field of Classification Search
CPC ..... B24B 49/14; B24B 49/16; B24B 37/08; B24B 37/10; B24B 37/12; B24B 37/16; B24B 37/015; B24B 55/02; B24B 7/228
(Continued)

(56) References Cited

U.S. PATENT DOCUMENTS

2001/0008801 A1 7/2001 Toyama
2006/0040589 A1* 2/2006 Ising ..... B24B 37/08 451/8

(Continued)

FOREIGN PATENT DOCUMENTS

CN 104253072 A 12/2014
DE 10007390 A1 10/2000

(Continued)

OTHER PUBLICATIONS

JP 20030026840; filed Feb. 4, 2003, Japanese Office Action dated Dec. 1, 2022 (11 pages).

(Continued)

*Primary Examiner* — Eric J Rosen
*Assistant Examiner* — Sharonda T Felton
(74) *Attorney, Agent, or Firm* — Barclay Damon LLP

(57) ABSTRACT

A machining machine comprises a first support disk, a first working disk coupled to the first support disk, and a counter bearing element positioned to define a working gap between the first working disk and the counter bearing element. The first working disk and the counter bearing element are configured to rotate relative to each other to machine at least one side of a flat workpiece. A pressure volume is positioned between the first support disk and the first working disk and is configured to hold a pressure fluid, which generates a pressure configured to deform the first working disk. One or more temperature-controlling channels are positioned within the first working disk and configured to hold a temperature-controlling fluid that is configured to control a temperature of the first working disk, wherein the one or more temperature-controlling channels are fluidly separate from the pressure volume.

14 Claims, 2 Drawing Sheets

(58) Field of Classification Search
USPC ..... 451/262, 753, 449
See application file for complete search history.

(56) References Cited

U.S. PATENT DOCUMENTS

| | | | | |
|---|---|---|---|---|
| 2014/0170781 | A1 | 6/2014 | Albrecht et al. | |
| 2017/0225292 | A1* | 8/2017 | Boller | B24B 49/14 |

FOREIGN PATENT DOCUMENTS

| | | | |
|---|---|---|---|
| DE | 102004040429 | B4 | 12/2009 |
| DE | 102006037490 | B4 | 4/2011 |
| DE | 102016102223 | A1 | 8/2017 |
| JP | 2006055984 | A | 2/2003 |
| JP | 2004-237373 | A | 8/2004 |
| KR | 1020170094520 | A | 8/2017 |
| TW | I455793 | A | 2/2012 |
| TW | 201436942 | A | 10/2014 |
| TW | 201729937 | A | 9/2017 |
| TW | 201935548 | A | 9/2019 |

OTHER PUBLICATIONS

TW 20210128941; filed Aug. 5, 2021, Taiwan Office Action dated Mar. 21, 2023 (17 pages).
TW 20210128941; filed Aug. 5, 2021, English translation of Taiwan Office Action dated Mar. 21, 2023 (18 pages).
KR 10-2021-0126378; Filing Date Sep. 24, 2021; Office Action Summary; Mailing Date Dec. 12, 2023 (8 pages).
KR 10-2021-0126378; Filing Date Sep. 24, 2021; Office Action Summary; Mailing Date Dec. 12, 2023 (1 page).

* cited by examiner

DOUBLE-SIDE OR ONE-SIDE MACHINING MACHINE

CROSS REFERENCE TO RELATED INVENTION

This application is based upon and claims priority to, under relevant sections of 35 U.S.C. § 119, German Patent Application No. 10 2020 125 246.3, filed Sep. 28, 2020, the entire contents of which are hereby incorporated by reference.

TECHNICAL FIELD

The invention relates to a double-side or one-side machining machine with a preferably annular first working disk which is fastened to a first support disk, and with a counter bearing element, wherein the first working disk and the counter bearing element can be driven to rotate relative to each other by at least one drive shaft, wherein a working gap is formed between the first working disk and the counter bearing element to machine both sides or one side of flat workpieces, wherein a pressure volume is arranged between the first support disk and the first working disk and is connected to a pressure fluid supply which can be actuated such that a pressure is built up in the pressure volume that generates a predetermined deformation of the first working disk, and wherein temperature-controlling channels are provided for controlling the temperature of the first working disk that are connected to a temperature-controlling fluid supply.

BACKGROUND

Flat workpieces such as wafers are simultaneously machined on both sides in double-side machining machines. For this purpose, double-side machining machines have a top working disk and a bottom working disk between which a working gap is formed in which the workpieces to be machined are guided during processing. The top working disk is fastened to a top support disk, and the bottom working disk is fastened to a bottom support disk. For machining, a relative rotation between the working disks is produced by rotatably driving at least one of the working disks together with its support disk. Double-side machining machines are known in which so-called rotor disks are guided in the working gap. The rotor disks generally accommodate workpieces to be machined in circular openings in a floating manner. By suitable kinematics, it is ensured that the rotor disks also rotate within the working gap during the relative rotation of the working disks. As a result, the workpieces move along cycloid paths within the working gap. Particularly consistent surface machining is hereby achieved.

With machining machines of the kind at issue here, a change in the working gap arises between the working disks due to the process heat which arises during machining. In particular, a heat-related deformation of the working disks occurs and hence a deviation in the gap geometry from the stipulated shape. This negatively influences the result of machining. This applies in particular to the very high machining requirements of so-called prime wafers.

A two-disk polishing machine is known from DE 100 07 390 B4, in particular for machining semiconductor wafers. In this case, cooling channels are formed in a support disk bearing a polishing disk, or in the support disk and in the polishing disk, by which cooling takes place to prevent undesirable influences on the geometry of the working gap. Moreover, a relative radial movement is permitted between a base support and the support disk, whereby a deformation is reduced when temperatures of the base support and support disk differ.

It is known from DE 10 2004 040 429 B4 to counteract negative effects from the arising process heat by controlling the temperature of the working disks. One or more channels are formed in the support disks through which corresponding temperature-controlling fluid such as cooling water is conducted. In practice, these temperature-controlling apparatuses cannot, however, always satisfy the maximum precision requirements in machining.

Furthermore, an apparatus for mechanically deforming the top support disk, and with it the top working disk fastened thereto, is known from DE 10 2006 037 490 B4. With this apparatus, an initially flat working surface of the top working disk can be changed to a slightly concave surface. Conversely, an initially slightly convex working surface of the top working disk can be changed into a flat, or respectively concave working surface. With this global deformation of the top working disk as well, not all of the deviations from the ideal gap geometry that arise during operation from process heat can be compensated.

A double-side or one-side machining machine is known from DE 10 2016 102 223 A1 with means for the local deformation of at least one of the working disks, in particular by introducing a pressure medium such as for example water into a pressure chamber acting on the working disk. In this manner, for example a local concave or convex deformation of the working disk can be created. Moreover, one or more cooling channels are formed in a support disk of the working disk for cooling. In addition, means can be provided for creating a global deformation as described in DE 10 2006 037 490 B4.

A problem with known systems is that the working disk directly bordering the working gap can heat up more during operation than the support disk bearing it. This can create tension between the working disk and the support disk. Depending on the temperature difference, a mutual shift between the support disk and working disk can also occur. During subsequent cooling after operation, the disks do not completely return to their previous position due to a frictional force counteracting the movement, for example from a screwed connection. A force differential can therefore remain between the disks to the amount of twice the frictional force after complete cooling. This can in turn yield different local geometries. Moreover, the global geometry of the working disk can also be changed by the changed tension between the support disk and working disk. Significant temperature differences can also occur during operation between a side of the working disk bordering the working gap and an opposite side of the working disk. These can lead to different thermal expansions of the two sides, which can cause a bulge in the working disk and therefore also a change in the local geometry.

Such geometric changes have a negative effect on the machining results and must be compensated at great expense for example by the means explained with reference to the prior art. In the prior art according to DE 10 2016 102 223 A1, the flexibility in adjusting the desired local geometry as well as the pressure that can be used to adjust the local geometry are moreover limited.

BRIEF SUMMARY OF THE INVENTION

Proceeding from the explained prior art, the object of the invention is therefore to provide a double-side or one-side machining machine of the aforementioned type that easily, reliably and flexibly makes it possible to always ensure the desired geometry of the working gap.

The invention achieves the object for a double-side or one-side machine of the aforementioned type in that the temperature-controlling channels are arranged within the first working disk so that the temperature-controlling channels are arranged closer to the working gap than the pressure volume, and the temperature-controlling channels are fluidly separate from or otherwise not connected to the pressure volume.

The machining machine can for example be a polishing machine, lapping machine, or a grinding machine. A working gap is formed between the first working disk and a counter bearing element such as a simple weight or pressure cylinder with one-side machining machines, or a second working disk with double-side machining machines, in which workpieces to be machined such as wafers are machined on both sides or one side. The machining machine can be a double-side or a one-side machining machine. With a double-side machining machine, the bottom side and top side of workpieces can be preferably machined simultaneously in the working gap. Correspondingly, both working disks can have a working surface that machines the workpiece surface. With a one-side machining machine, only one workpiece side is contrastingly machined; for example, the bottom side by the bottom working disk. In this case, only one working disk has a working surface that machines the workpiece surface. The counter bearing element in this case only serves to form a corresponding counter bearing for machining by the working disk.

The workpieces can be accommodated for machining to float in a known manner in openings in rotor disks arranged in the working gap. The first working disk and the counter bearing element are driven to rotate relative to each other during operation, for example by a first and/or second drive shaft and at least one drive motor. Both the counter bearing element as well as the first working disk can be driven to rotate, for example in the opposite direction. It is, however, possible to only rotatably drive either the counter bearing element or first working disk. For example, with a double-side machining machine, rotor disks can be moved by suitable kinematics to rotate during this relative rotation through the working gap so that workpieces arranged in the rotor disks describe cycloid paths in the working gap. For example, the rotor disks can have teeth on their outer edge and/or on their inner edge that engage in associated teeth, for example of the first working disk. Such machines with so-called planetary kinematics are well-known.

In an embodiment, the first working disk is annular. The counter bearing element, or respectively the second working disk, can also be annular. The first working disk and the counter bearing element such as the second working disk then possess facing annular working surfaces between which the annular working gap is formed. The working surfaces can be covered with a working covering such as polishing cloths. Any support disks that hold the working disks can also be designed annular, or at least possess annular support sections to which the working disks are fastened. In an embodiment, more than one support disk per working disk can also be provided.

A preferably annular pressure volume is formed between the first support disk and the first working disk. The pressure volume is connected to a pressure fluid supply that is actuable such that a pressure is built up in the pressure volume that generates a predetermined local deformation of the first working disk. To the extent that the term fluid is used in this application, it can designate both a gas as well as a liquid. The pressure fluid can be a liquid, in particular water. By introducing the pressure fluid into the pressure volume, pressure can be exerted on the working disk, which is thin in comparison to the support disk, that leads to a deformation of the working disk. In particular, the working disk can be thereby changed to a locally concave shape by setting a low pressure in the pressure volume, to a locally flat shape by setting a medium pressure, and to a locally convex shape by setting a high pressure. The locally convex, or respectively concave deformation, or respectively shape, lies between the inner and outer edge of the annular first working disk, in particular in the radial direction. The pressure volume is a changeable pressure volume. The first working disk forms a membrane that deforms depending on the volume of the pressure volume produced by the different pressure.

The pressure fluid supply comprises a pressure fluid reservoir to which is connected at least one pressure line that is connected to the pressure volume. In an embodiment, a pump and a control valve can be arranged in the pressure line that can be actuated to build up the desired pressure within the pressure volume, for example by a control and/or regulation apparatus. In addition, the pressure fluid supply can comprise a pressure measuring apparatus that directly or indirectly measures the pressure in the pressure volume and can also send the measurements to the control and/or regulation apparatus. By suitably actuating the pressure fluid supply in the pressure volume, the required pressure for the desired working gap geometry can be adjusted on this basis. An unchanging distance between the working disks over the entire radial extent is for example desirable. The desired gap geometry can be adjusted in static operation and/or in dynamic operation, i.e., while machining a workpiece.

With the pressure volume, a smooth adjustment of the local shape of the first working disk between a maximum concave to maximum convex shape determined by the installation, geometric and material boundary conditions is basically possible. The first working disk can in principle have any thickness. Depending on the desired adjustment range of the disk geometry, the working disk possesses a suitable thickness so that it can be deformed with the available pressure depending on its surface area in particular its ring width, or respectively its turning radius. As explained in DE 10 2016 102 223 A1, the possibility of adjusting the local geometry of the first working disk in a radial direction can compensate for a change in the gap from the influence of temperature during machining.

In an embodiment, temperature-controlling channels for controlling the temperature of the first working disk are provided, wherein the temperature-controlling channels are arranged within the working disk such that the temperature-controlling channels are arranged closer to the working gap than the pressure volume. The temperature-controlling channels are configured to conduct a temperature-controlling fluid. They can for example be designed like a labyrinth. A temperature-controlling fluid, for example a temperature-controlling liquid such as water can be guided through the temperature-controlling channels while the machine is operating to control the temperature, in particular to cool the working disk. A heat-related deformation of the working disk can be counteracted to a certain extent by the temperature-controlling channels.

In contrast to the prior art, the temperature-controlling channels can be arranged closer to the working gap than the pressure volume due to the arrangement of the temperature-controlling channels according to the invention within the first working disk, in particular exclusively within the first working disk. In particular, only one supply and discharge for the temperature-controlling fluid can run through the support disk that are connected to the temperature-controlling fluid supply. Due to the temperature-controlling channels arranged closer to the working gap, the cooling of the first working disk is more effective so that in particular the above-explained problems of a stronger heating of the working disk than the support disk and a stronger heating of a side of the working disk bordering the working gap can be avoided. Corresponding tension between the first working disk and the first support disk, or respectively undesirable deformations of the first working disk, can be avoided. Instead, the temperature-controlling channels are located as close as possible to the surface of the working disk bordering the working gap so that penetration of the process heat through the working disk into the support disk can be largely prevented. In order to further minimize the transfer of heat between the first working disk and first support disk, it is possible to provide the first support disk and/or the first working disk in the region of their contact with bars or other elevations so that the contact surface between the disks is minimized.

In an embodiment, the temperature-controlling channels are not connected to the pressure volume, which is also different from the prior art where these are connected to each other and form a common circuit. In the invention, separate fluid systems (circuits) are provided for the temperature-controlling channels on the one hand, and for the pressure volume on the other hand. This enables a more flexible adjustment of the pressure in the pressure volume independent of the pressure in the temperature-controlling channels. In addition, the useful pressure in the pressure volume for adjusting the local geometry is not limited by the pressure in the temperature-controlling channels in contrast to the prior art.

According to one embodiment, the counter bearing element can be formed by a preferably annular second working disk, wherein the working disks are arranged coaxial to each other, and wherein the working gap is formed between the working disks to further machine one side of flat workpieces. In particular, the machining machine is a double-side machining machine. The second working disk can be fastened to a second support disk. It can also have a pressure volume and/or temperature-controlling channels as explained with respect to the first working disk and the first support disk. This is however not essential.

According to another embodiment, the first working disk can be formed from two preferably annular disks that are connected to each other, between which the temperature-controlling channels are formed, wherein one of the disks borders the working gap. The first working disk is therefore constructed in two parts, wherein it forms the temperature-controlling channels between the two partial disks similar to a sandwich construction. This design makes the formation of the temperature-controlling channels exclusively within the first working disk very easy in terms of construction. According to a particularly practical embodiment, the two disks can be screwed to each other. However, other types of fastening are of course also conceivable.

The first support disk can also be screwed to the first working disk. However, other types of fastening are also conceivable. The same also holds true for a second working disk and a second support disk.

To achieve particularly effective temperature control, in particular cooling, the temperature-controlling channels can form a channel labyrinth formed in the first working disk. The temperature-controlling channels can for example be introduced by being milled into the first working disk, for example one or two disks forming the first working disk.

According to another embodiment, the pressure fluid supply can supply pressure fluid through a drive shaft connected to the first support disk, and/or the temperature-controlling fluid supply can supply and discharge temperature-controlling fluid through a drive shaft connected to the first support disk. The supply of the pressure volume is separate from the supply and discharge of the temperature-controlling channels. The advantage of supplying and discharging through a drive shaft is that only one transition between the rotating and fixed system is necessary.

According to another embodiment, a distance measuring apparatus can be provided to determine the thickness of the working gap and/or working disk deformation. The distance measuring apparatus can comprise at least one distance measuring sensor that measures the working gap thickness and/or the working gap deformation at least one place in the working gap. For example, the at least one distance measuring sensor can measure the distance between the first working disk and a support disk holding the first working disk which acts in this case as a membrane. The distance measuring sensor is then preferably arranged on the radius of the maximum local deformation of the first working disk, in particular in the middle of the working disk. The distance measuring sensor can also measure the distance between the first working disk and the counter bearing element, or respectively between the working disks, and for example be arranged in the second working disk.

The distance measuring apparatus can moreover comprise at least two distance sensors that measure the working gap thickness at least two radially spaced locations. For example, the distance measuring sensors can measure the distance between the first working disk and the counter bearing element, or respectively the distance between the working disks. The distance sensors can for example be arranged in a region of an edge of the working gap and in the middle of the working gap. According to another embodiment, the distance measuring apparatus can comprise at least three distance measuring sensors that measure the working gap thickness at least three radially spaced points of the working gap to achieve improved measurement of the working gap geometry. In this case, the distance sensors can for example measure the distance at the inner and outer edge and in the middle of the working gap. It is possible for all distance measuring sensors to measure the distance between the first working disk and the counter bearing element, or respectively between the working disks, and for example be arranged in the second working disk. A combination of the above-explained embodiments of the distance measuring apparatus is however also possible in which distance measuring sensors, for example on the inner and outer edge, measure the distance between the first working disk and the counter bearing element, or respectively the distance between the working disks, and in which a distance measuring sensor in the middle of the working gap measures the distance between the first working disk and a first support disk that holds the first working disk.

According to another embodiment, the distance measuring apparatus can have at least one distance measuring sensor arranged in the first support disk that measures the distance to a top side of the pressure volume. For example, a radial deformation of the first working disk can be detected with such a sensor. The sensor can be realized in various forms. For example, it can be an optical sensor, a mechanical sensor, an inductive sensor or an eddy current sensor.

According to another embodiment, a control and/or regulation apparatus can be provided that actuates the pressure fluid supply depending on the measurement data received by the distance measuring apparatus such that a predetermined geometry of the first working disk is created. In particular, the control and/or regulation apparatus can actuate the pressure fluid supply in order to generate a pressure in the pressure volume that causes a predetermined local deformation of the first working disk. In this embodiment, the local deformation of the first working disk is controlled, or respectively regulated by a control and/or regulation apparatus at whose input the measurements are supplied from the distance measuring apparatus. If the control and/or regulation apparatus discerns a deviation in the working gap geometry from a predetermined geometry based on the values measured by the distance measuring apparatus, it actuates the pressure fluid supply such that the working gap resumes the predetermined geometry as closely as possible. This controlling and/or regulation according to the invention can in particular be automatic during production operation of the double or one-side machining machine. By supplying the temperature-controlling channels with temperature-controlling fluid, an undesirable deformation of the working disk(s) is moreover counteracted. This can also be accomplished by the control and/or regulation apparatus. For example, the control and/or regulation apparatus can be regulated by suitably controlling the temperature of the temperature-controlling fluid to a predetermined temperature at the inlet and/or at the outlet of the temperature-controlling channels, or to a predetermined temperature difference between the temperature present at the inlet and that at the outlet of the temperature-controlling channels.

Moreover, means can be provided for generating a global deformation of the counter bearing element, in particular the second working disk. The control and/or regulation apparatus can be designed to also actuate the means for deforming the counter bearing element. The actuation by the control and/or regulation apparatus can moreover be carried out depending on the measurements obtained from the distance measuring apparatus.

If at least three distance measuring sensors are provided that can measure the distance at least three radially spaced points in the working gap, the global adjustment of the working gap can be carried out by a global deformation of the second working disk through a reconciliation of the distance measuring sensors provided at the inner and outer edge of the working gap. The third, middle distance measuring sensor arranged between the inner and outer distance measuring sensors monitors the planarity of the working disks in a radial direction between the inner and outer edge of the working disks, i.e., any deviation from a flat plane and in a radial direction. This local parallelism can also be optimally adjusted by suitable local deformation of the first working disk. The goal is to adjust the distance values measured by all distance measuring sensors by suitably deforming the first working disk and/or the second working disk such that the desired target values for the working gap and the planarity, or respectively deviation therefrom, are obtained to achieve an optimum working result.

According to another embodiment, the counter bearing element is a second working disk fastened to a second support disk, and the means for deforming the second working disk comprises a support ring on which the second support disk is suspended. A controllable means (see element 23 in FIG. 3) or a control are arranged between the support ring and a ring section of the second support disk lying radially to the outside of the support ring by means of which a radial force is applied over the perimeter of the support ring to the second support disk with the assistance of a force generator, wherein the control and or regulation apparatus adjusts the force of the force generator depending on the distance values measured by the distance measuring apparatus, or by the pressure values measured by a measuring apparatus. The support ring can be rotatably connected to a top working shaft for rotatably driving the second support and working disk.

In an embodiment, a small-width annular channel running in a peripheral direction can be provided between the support ring and a ring section, and the force generator is a pressure generator that is connected to the annular channel and generates a predetermined pressure in the annular channel.

In an embodiment, a cylinder with a piston can be arranged on the support ring, the piston can interact with a cylindrical hole in the support ring, the cylindrical hole being connected via a transverse hole to the annular channel, and a hydraulic medium is accommodated in the annular channel and cylindrical hole. The piston can be actuated by a controllable pressure from a hydraulic source. In particular, the actuation can be hydropneumatic.

The aforementioned embodiments for globally deforming the working disk are known in principle from DE 10 2006 037 490 B4 and can be used in a corresponding manner in the present invention.

According to another embodiment, provision can be made for the first working disk to be fastened only in the region of its outer edge and in the region of its inner edge to the first support disk. As already explained, the working disks can particularly be annular. The preferably annular pressure volume is then formed between the first working disk and the first support disk. In the aforementioned embodiment, the first working disk is only fastened to the first support disk in the region of its radially outside and radially inside edge bordering the working disk, for example screwed along a divided circle. Between these edge regions, the working disk is contrastingly not fastened to the support disk. In particular, the pressure volume can be formed within this region. In this manner, the working disk possesses the required mobility in order to be deformed in the desired manner by building up a suitable pressure in the pressure volume. The attachment of the working disk to the support disk is selected so that the contact surface on the inner and outer edge is kept as narrow as possible in order to achieve a specific deformation over the entire surface of the working disk if possible.

BRIEF DESCRIPTION OF THE DRAWINGS

Exemplary embodiments of the invention are explained in greater detail below based on figures. Schematically.

The same reference numbers refer to the same objects in the figures unless indicated otherwise.

DETAILED DESCRIPTION OF THE INVENTION

Figure 1:
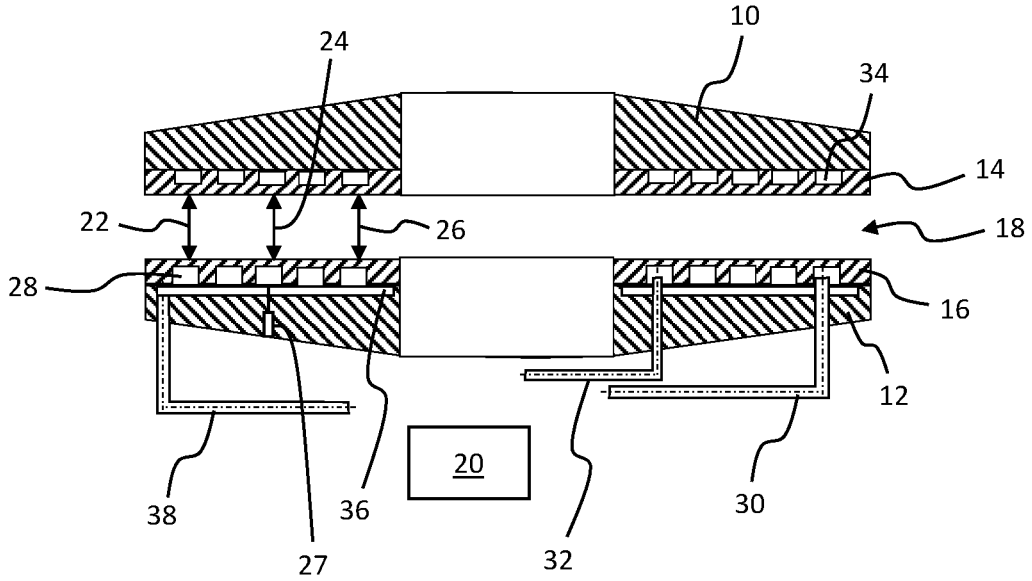
FIG. 1 illustrates a sectional view of a portion of an embodiment of a double-side machining machine.

The double-side machining machine depicted merely as an example in FIG. 1 has an annular first, bottom support disk 12 and a second, top support disk 10 that is also annular. An annular first, bottom working disk 16 is fastened to the bottom support disk 12, and a second, top working disk 14 that is also annular is fastened to the top support disk 10. Between the annular working disks 14, 16, an annular working gap 18 is formed in which flat workpieces such as wafers are machined on both sides during operation. The double-side machining machine can for example be a polishing machine, lapping machine, or a grinding machine.

The top support disk 10, and with it the top working disk 14, and/or the bottom support disk 12 and with it the bottom working disk 16, can be rotatably driven relative to each other by a suitable drive apparatus comprising for example a top drive shaft, and/or a bottom drive shaft, as well as at least one drive motor. The drive apparatus is known per se and will not be described further for reasons of clarity. In a manner which is also known per se, the workpieces to be machined can be held to float in rotor disks in the working gap 18. By suitable kinematics, for example planetary kinematics, it can be ensured that the rotor disks also rotate through the working gap 18 during the relative rotation of the support disks 10, 12, or respectively working disks 14, 16. A control and/or regulation apparatus 20 controls, or respectively regulates the operation of the double-side machining machine. Moreover, three distance measuring sensors illustrated by arrows 22, 24, 26 are provided in the portrayed example that measure the distance between the working disks 14, 16 at three radially spaced points of the working gap 18. The measurement data from the distance measuring sensors 22, 24, 26 are provided to the control and/or regulation apparatus 20 that uses this measurement data to control, or respectively regulate the double-side machining machine.

In the example shown in FIG. 1, labyrinth-like temperature-controlling channels 28 are provided within the bottom working disk 16. The temperature-controlling channels 28 are connected by a feed 30 and a discharge 32, for example via a drive shaft driving the bottom support disk 12 and the bottom working disk 16, to a temperature-controlling fluid supply. By means of the control and/or regulation apparatus 20, for example a predetermined temperature value of the temperature-controlling fluid can be regulated at the inlet and/or at the outlet of the temperature-controlling channels, or a predetermined temperature difference can be regulated between the temperature present at the inlet and that at the outlet of the temperature-controlling channels by correspondingly adjusting the temperature of the temperature-controlling fluid. In the shown example, labyrinthine temperature-controlling channels 34 are also formed in the top working disk 14 that are also connected to a temperature-controlling fluid supply via a feed and discharge (not shown). In an embodiment, the feed and discharge are similar to that shown in the bottom working disk 16. This temperature-controlling fluid supply is also controlled by the control and/or regulation apparatus 20. By supplying the temperature-controlling channels 28, or respectively 34 with a temperature-controlling fluid, for example a coolant such as water, heating of the working disks 14, 16 and transfer of heat into the support disks 10, 12 can be effectively counteracted so that corresponding changes in geometry are reduced.

Moreover, a pressure volume 36 that is annular in the shown example is formed between the bottom support disk 12 and the bottom working disk 16 and is connected via a feed 38, for example also via a drive shaft driving the bottom support disk 12 and the bottom working disk 16, to a pressure fluid supply. In addition, an additional distance measuring sensor 27 is arranged in the bottom support disk 10 that measures the distance to the top side of the pressure volume 36. The measurement data from this distance measuring sensor 27 are also applied to the control and/or regulation apparatus 20. The pressure fluid supply is also actuated by the control and/or regulation apparatus 20. By correspondingly introducing pressure fluid into the pressure volume 28, a local deformation of the bottom working disk 16 can be created, in particular a local concave or convex deformation as described in principle in DE 10 2016 102 223 A1.

As can be seen in FIG. 1, the temperature-controlling channels 28 are arranged closer to the working gap 18 than the pressure volume 36. Moreover, the duct systems of the pressure volume 36 and the temperature-controlling channels 28 are not connected to each other, but are instead separately controllable, or respectively regulatable.

Figure 2:
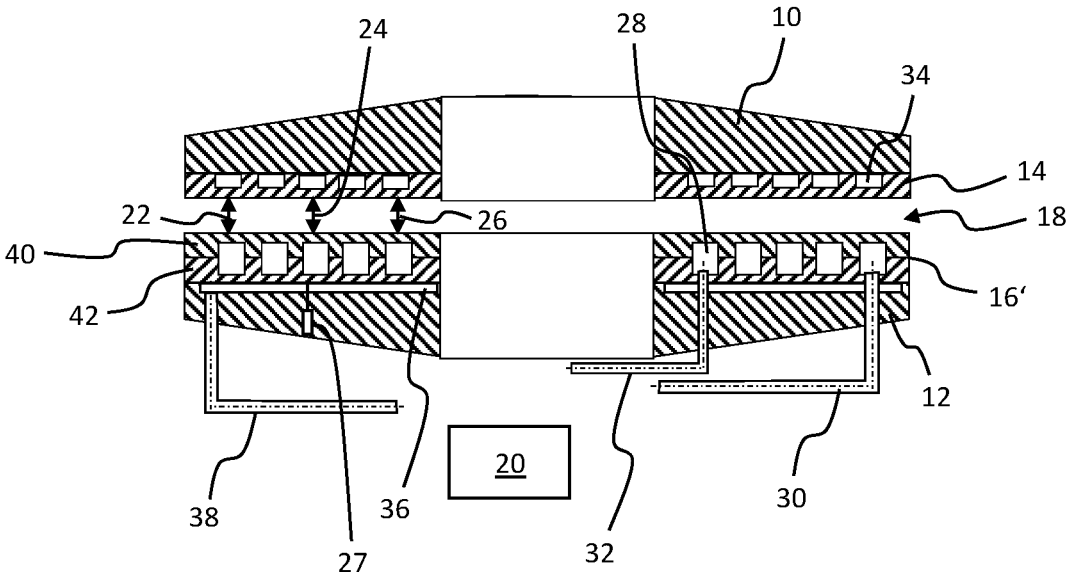
FIG. 2 illustrates a sectional view of a portion of another embodiment of a double-side machining machine.

The exemplary embodiment shown in FIG. 2 largely corresponds to the exemplary embodiment shown in FIG. 1. It only differs in terms of the configuration of the bottom working disk 16' that, in the example shown in FIG. 2, is formed from two annular disks 40, 42 that are fastened to each other. The temperature-controlling channels 28 are configured in the manner of a sandwich construction between the disks 40, 42. In this manner, the temperature of the bottom working disk 16' can be controlled very effectively.

Figure 3:
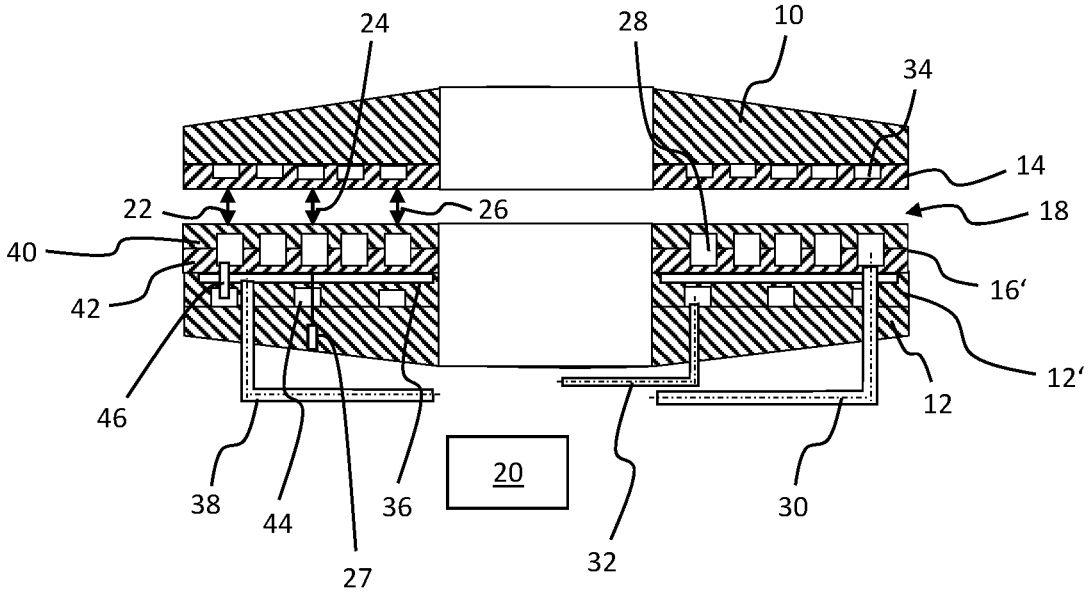
FIG. 3 illustrates a sectional view of a portion of still another embodiment of a double-side machining machine.

The exemplary embodiment shown in FIG. 3 also largely corresponds to the exemplary embodiment shown in FIG. 2, wherein in contrast to the exemplary embodiment according to FIG. 2, another bottom support disk 12' is arranged between the bottom support disk 12 and the bottom working disk 16' and is connected on the one hand to the bottom support disk 12 and on the other hand to the bottom working disk 16'. In the exemplary embodiment according to FIG. 3, labyrinthine temperature-controlling channels 44 are also formed in the bottom support disk 12' supporting the bottom working disk 16' and are connected via a connecting line 46 to the temperature-controlling channels 28 formed in the bottom working disk 16', and are connected via the same feed 30 and discharge 32 to the temperature-controlling fluid supply. By means of these additional temperature-controlling channels 44 in the bottom support disk 12', heat transfer from the bottom working disk 16' to the bottom support disk 12 is more effectively prevented.

LIST OF REFERENCE SIGNS

10 Second support disk
12 First support disk
12' First support disk
14 Second working disk
16 First working disk
16' First working disk
18 Working gap
20 Control and/or regulation apparatus
22 Distance measuring sensor
24 Distance measuring sensor
26 Distance measuring sensor
27 Distance measuring sensor
28 Temperature-controlling channels
30 Feed
32 Discharge
34 Temperature-controlling channels
36 Pressure volume
38 Feed
40 Disk

42 Disk
44 Temperature-controlling channels
46 Connecting line

The invention claimed is:

1. A machining machine comprising:

a first support disk;

a first working disk coupled to the first support disk;

a counter bearing element positioned to define a working gap between the first working disk and the counter bearing element, wherein the first working disk and the counter bearing element are configured to rotate relative to each other to machine at least one side of a flat workpiece;

a pressure volume comprising a duct system is positioned between the first support disk and the first working disk, and is configured to hold a pressure fluid, wherein the pressure fluid generates a pressure configured to deform the first working disk; and one or more temperature-controlling channels positioned within the first working disk and configured to hold a temperature-controlling fluid that is configured to control a temperature of the first working disk, wherein the one or more temperature-controlling channels are arranged closer to the working gap than the pressure volume and are fluidly separate from the pressure volume.

2. The machining machine according to claim 1, wherein the counter bearing element is formed by a second working disk, wherein the first and second working disks are arranged coaxially to each other, and wherein the working gap is defined between the first and a second working disk.

3. The machining machine according to claim 1, wherein the first working disk is formed from two annular disks that are connected to each other, wherein the one or more temperature-controlling channels are formed between the two annular disks of the first working disk, and wherein one of the two annular disks border the working gap.

4. The machining machine according to claim 1, wherein the one or more temperature-controlling channels form a channel labyrinth in the first working disk.

5. The machining machine according to claim 1, wherein at least one of: (1) the pressure fluid is supplied through a drive shaft connected to the first support disk; and (2) the one or more temperature-controlling channels receive and discharge temperature-controlling fluid through a drive shaft connected to the first support disk.

6. The machining machine according to claim 1, further comprising a distance measuring apparatus configured to determine at least one of: (1) a thickness of the working gap; and (2) a deformation of at least one of the first and a second working disk.

7. The machining machine according to claim 6, wherein the distance measuring apparatus comprises at least one distance measuring sensor configured to measure a distance between the first working disk and the first support disk in at least one place within the working gap.

8. The machining machine according to claim 6, wherein the distance measuring apparatus comprises at least two distance measuring sensors configured to measure a distance between the first working disk and the counter bearing element, wherein the distance is measured at least at two radially spaced points in the working gap.

9. The machining machine according to claim 8, wherein the distance measuring apparatus comprises at least one distance measuring sensor arranged in the first support disk that is configured to measure a distance to a top side of the pressure volume.

10. The machining machine according to claim 9, further comprising a control configured to control the pressure fluid delivered to the pressure volume depending on measurement data received by the distance measuring apparatus to create a predetermined geometry of the first working disk.

11. The machining machine according to claim 1, wherein the counter bearing element is configured for a global deformation.

12. The machining machine according to claim 10, wherein the control is configured to control an actuation of the counter bearing resulting in a global deformation of the counter bearing element.

13. The machining machine according to claim 11, wherein the counter bearing element is a second working disk fastened to a second support disk, wherein the second support disk is suspended from a support ring that is configured to deform the second working disk.

14. The machining machine according to claim 13, wherein a force generator is configured to be adjusted in order to change a radial force applied by the force generator depending on one of distance values measured by a distance measuring apparatus, and the pressure values measured by a measuring apparatus.

* * * * *